US005582334A

United States Patent [19]

Blazer et al.

[11] Patent Number: 5,582,334

[45] Date of Patent: Dec. 10, 1996

[54] MOTH INHIBITING MULTIGARMENT CLOTHES HANGER

[75] Inventors: Joseph S. Blazer, deceased, late of South Amboy, N.J., by Betty Blazer, Administratrix; Sean B. Appleyard, Bay St. Louis, Miss.

[73] Assignee: Ink-Rol Products, Inc., Bay St. Louis, Miss.

[21] Appl. No.: 442,127

[22] Filed: May 16, 1995

[51] Int. Cl.[6] ..... A47G 25/28; A47G 25/38; A47G 25/60

[52] U.S. Cl. ..... 223/86; 223/DIG. 2; 223/85

[58] Field of Search ..... 223/DIG. 1, DIG. 2, 223/DIG. 3, DIG. 4, 86, 85, 87; D6/315; 211/113

[56] References Cited

U.S. PATENT DOCUMENTS

| | | | |
|---|---|---|---|
| D. 93,143 | 8/1934 | Spragg | D6/315 |
| 1,741,069 | 12/1929 | Newsom | 223/86 |
| 4,768,686 | 9/1988 | Storti | 223/86 |
| 5,033,661 | 7/1991 | Baun | 223/86 |
| 5,098,713 | 3/1992 | Mattesky | 223/86 |

FOREIGN PATENT DOCUMENTS

| | | | |
|---|---|---|---|
| 2551090 | 5/1977 | Germany | 223/DIG. 1 |

*Primary Examiner*—Bibhu Mohanty
*Attorney, Agent, or Firm*—Mark C. Jacobs

[57] ABSTRACT

A multigarment, insect infestation inhibiting hanger device for use on a clothes bar. The device, which saves closet space, has a hook portion for disposition on a clothes bar on one end thereof. The hook portion is also disposed within or through a main body member cut from preferably incense cedar or molded of a mixture of incense cedar chips and a suitable resin. The device is configured to receive either a plurality of hanger in slots of garment receivers, or garment hanging loops upon upstanding segments of these garment receivers. The device permits the user to compactly group similar garments together for organization of the closet.

18 Claims, 4 Drawing Sheets

MOTH INHIBITING MULTIGARMENT CLOTHES HANGER

FIELD OF THE INVENTION

This invention pertains to secondary garment hanger devices for use in closets.

BACKGROUND OF THE INVENTION

From a terminology point of view, a primary garment hanger is the hanger, be it metal, wood or plastic upon which a garment is placed for disposition upon a clothes bar or rod within the confines of a closet. A secondary garment hanger is a hanger which is to be disposed upon a clothes rod within a closet, and which is adapted to receive other hangers, which are in fact primary hangers as previously enunciated.

Multigarment clothes hanger devices in the past have been multigarment primary hangers. Many men, for example, have metal or plastic devices having a plurality of spaced bars joined together to form a body which is connected in one fashion or another to a hook portion which in turn is disposed upon a clothes bar. While such devices are suitable for men's pants, they are not intended for suits or jackets, and in no way do they inhibit moth or other insect infestation.

It is known in the art to have plastic receptacles for paradichlorbenzene or moth balls. It is even known to provide hooks for mounting such receptacles upon clothes bars. While paradichlorobenzene does inhibit moth infestation, one can not wear clothes immediately after removing them from a closet which has been "protected" by paradichlorobenzene, due to the offensive odor of such chemical, and because some people are even allergic to the smell of moth balls. There is a need therefore for a clothes protector which can be brought into close proximity of a maximum of garments to afford insect protection, and which will not be malodorous.

It is an object therefore of this invention to provide a combination primary and secondary hanger device for use in clothing closets which is not malodorous.

It is another object of the invention to provide a secondary hanger which is adapted to inhibit clothes eating moth and other insect infestation in hanging garments for a large number of garments in the space normally occupied by about three garments on hangers.

It is a third object to provide a two piece hanger device that is capable of holding at least two and perhaps as many as twelve garments simultaneously, while saving closet space.

It is a still further object to provide a moth and other insect inhibiting hanger device that can be used as a primary and a secondary hanger either separately or simultaneously.

Other objects of the invention will in part be obvious and will in part appear hereinafter.

The invention accordingly comprises the device which possesses the features properties and the relation of components which are exemplified in the following detailed disclosure and the scope of the application of which will be indicated in the appended claims.

For a fuller understanding of the nature and objects of the invention reference should be made to the following detailed description, taken in conjunction with the accompanying drawings.

SUMMARY OF THE INVENTION

A multigarment closet space saving, cloth-eating insect infestation inhibiting hanger device for use on a clothes bar. The device has a hook portion for disposition on a clothes bar on one end thereof, the other end of which hook is disposed within or through a main body member. The device is configured to receive either a plurality of hanger hooks, or garment hanging loops directly.

The main body is cut from incense cedar or molded of a mixture of incense cedar chips and a suitable resin. Other moth, silverfish and other protein eating insect inhibiting odoriferous wood materials can be utilized in place of cedar.

DESCRIPTION OF THE PREFERRED EMBODIMENT

Figures 1, 2, 3, 4:
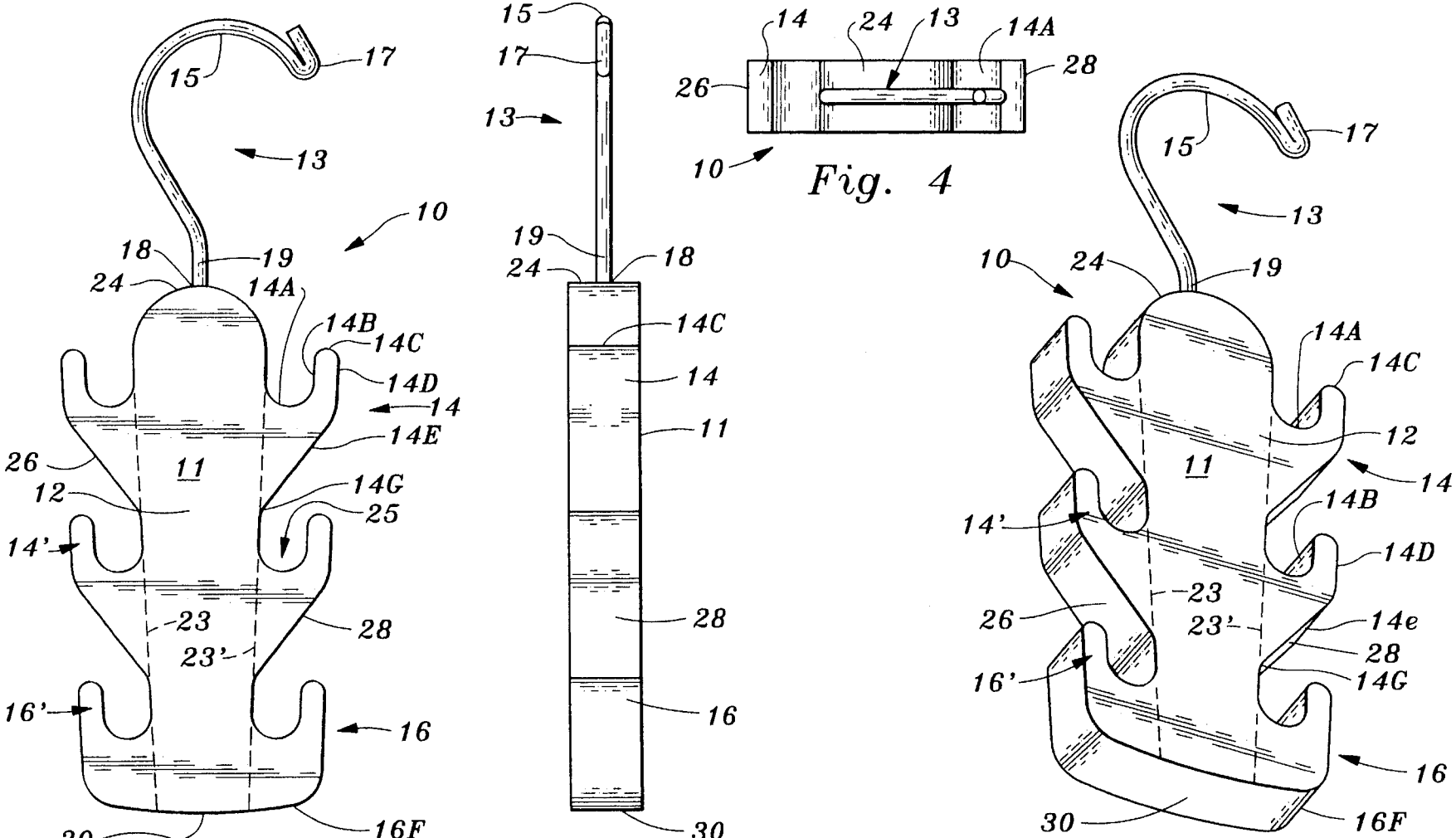
FIG. 1 is a front view of a first embodiment of this device which is adapted to hold six garments. The rear view is a mirror image.
FIG. 2 is a right side elevational view thereof.
FIG. 3 is a bottom left perspective view thereof.
FIG. 4 is a top plan view thereof.

In FIG. 1 there is shown the first embodiment of the invention. The device 10 comprises a main body 11 which is engaged to a hook 13. The main body 11 which is formed preferably from a section of cut incense cedar or other similarly suitable moth and other insect inhibiting wood, includes a preferably downwardly and inwardly tapering main section 12 which is defined by a top wall 24, left side wall 26, right side wall 28 and a bottom wall 30 as well as front and rear walls, 32 and 34 respectively.

The top and bottom walls, 24 and 30, may be curved as shown, or squared off as may be desired. The dotted lines 23 and 23' are depicted to show the artificial lines of demarcation between the main body 11 and the appended hanger receiving elements 14, designated first receivers and the main body and second hanger receiving elements 16. These dotted lines 23, 23', are in point of fact a continuation of the actual edge or side walls, 26 and 28 respectively.

The only difference between an element 14 receiver and an element 16 receiver lies at the bottom of the receiver; namely, wall 14E versus wall 16F. Wall 16F which is shown as being arcuate could be squared off or even come to a point if desired. On the other hand, the exact angle of wall 14E is not deemed critical. The taper as will be discussed infra, is to render the placement of individual hangers, each of which bears a garment, into the respective receivers, easier.

Thus each appended hanger element 14 is seen to be attached to the main body and for balance they are disposed in opposed mirror image pairs on the two side walls of the main body. Each receiver 14 constitutes the combination of a slot 25 and a generally finger-like upstanding solid segment, 14' and a supporting section. Element 14 's slot 25, is defined first by a section of the side wall either 26 on the left or 28 on the right side of the main body, which is adjacent to and spaced from the upstanding segment, 14' of the particular receiver, and second by a preferably arcuate concave portion 14A, which commences at the main body's side wall and terminates at a generally vertical edge 14B of the said upstanding segment 14'. As seen in the figures the slot 25 has a first angled portion bounded by inclined wall 14E and a second vertical portion, the second vertical portion has an arcuate convex base portion 14A bounded by vertical edges on both sides. One such vertical edge is shown as 14B.

The upstanding solid segment 14' commences at this second end of the arcuate portion, and has an inner edge 14B, which extends upwardly a finite distance to a point of termination at the first end of an upper edge which is a preferably arcuate convex edge, 14C, which may have a diameter the same as or greater or less than the concave portion of said slot. This edge 14C in turn terminates at a generally vertical outer edge 14D, preferably parallel to and spaced from said edge 14B. The distance between the two parallel edges 14B and 14D should preferably not exceed about ¼ inch as otherwise it will be impossible to place garment hanger loops thereupon.

Edge 14D may have a longer vertical extension than edge 14B and it terminates in an inwardly diverging edge 14E, which in turn terminates at a spaced downward location, 14G, along the sidewall of the main body, relative to the slot aspect of the receiver 14 to define a supporting third section of the receiver. The thickness of the supporting third section and of the upstanding segment is preferably the same as that of the main body.

Each element 14 on both sides of the main body may be the exact same or slightly different as may be desired. For aesthetics, however, it is recommended that each be the same and they are so shown in the figures.

It is to be noted that the uppermost element 14 is disposed the most outwardly from the vertical central axis of the main body. This is to provide ample clearance for each garment to hang adjacent the next garment within the confines of the vertically successive slots, 25.

Element 16, the lowermost receiver, and to be described next, is disposed the least outward. That is, there is the least amount of the main body between the two mirror image receivers 16. However, the reader is urged to note also the embodiment of FIG. 10 discussed below. Element 16, as shown here is the same as element 14 in that it includes a slot 25 and an upstanding segment 16'. However, rather than having a slanted edge similar to 14E, the last edge of element 16 is arcuate as shown and of no specific radius, and is designated 16F. Like its counter part of element 14 receiver 16 terminates at the side wall of the main body 11; namely, along the artificial dotted line 23 which is a continuation of one of the respective side walls. Edge 16F actually terminates at the interface of 23 and the bottom wall 30 of the main body 11. All other aspects of the slot and the upstanding segment of receiver 16 are preferably the same as discussed with respect to receiver 14.

While disclosed as being arcuate of no particular radius, edge 16F could also if desired, form a hard 90 degree corner with edge 16D or even be slanted similar to edge 14E if desired. But for aesthetics and to avoid snags with garments the configuration as shown in the figures is preferred.

Figure 5:
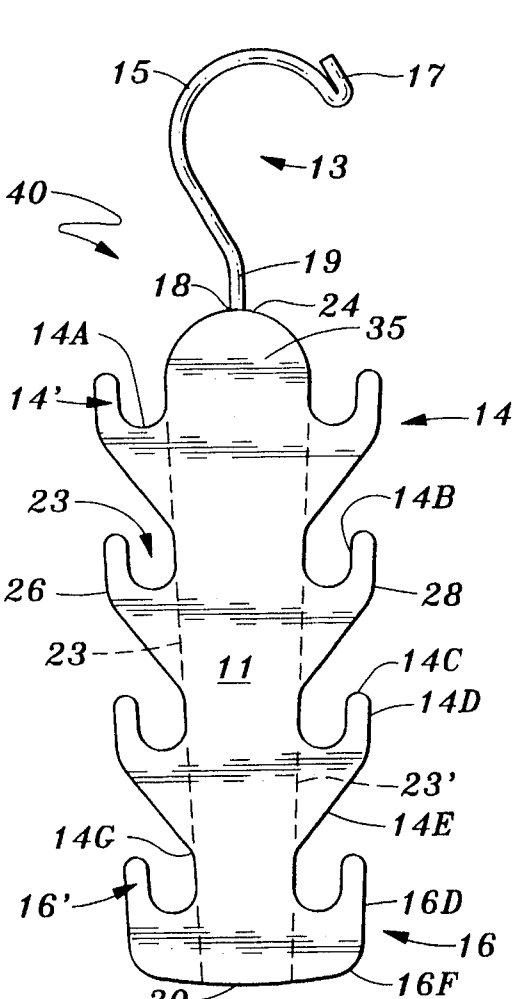
FIG. 5 is a front view of a second embodiment of this invention, and which is adapted to hold eight garments. The rear view is a mirror image thereof.

As can now be appreciated, the only difference between the embodiments 10 and 40 of FIGS. 1 and 5 respectively, is the fact that the second embodiment, 40, includes a third set of opposed mirror image receivers 14 on the opposite sides of the main body 11 in addition to the one pair of element 16 receivers. Thus additional text to distinguish the second embodiment from the first is deemed superfluous.

Figure 9:
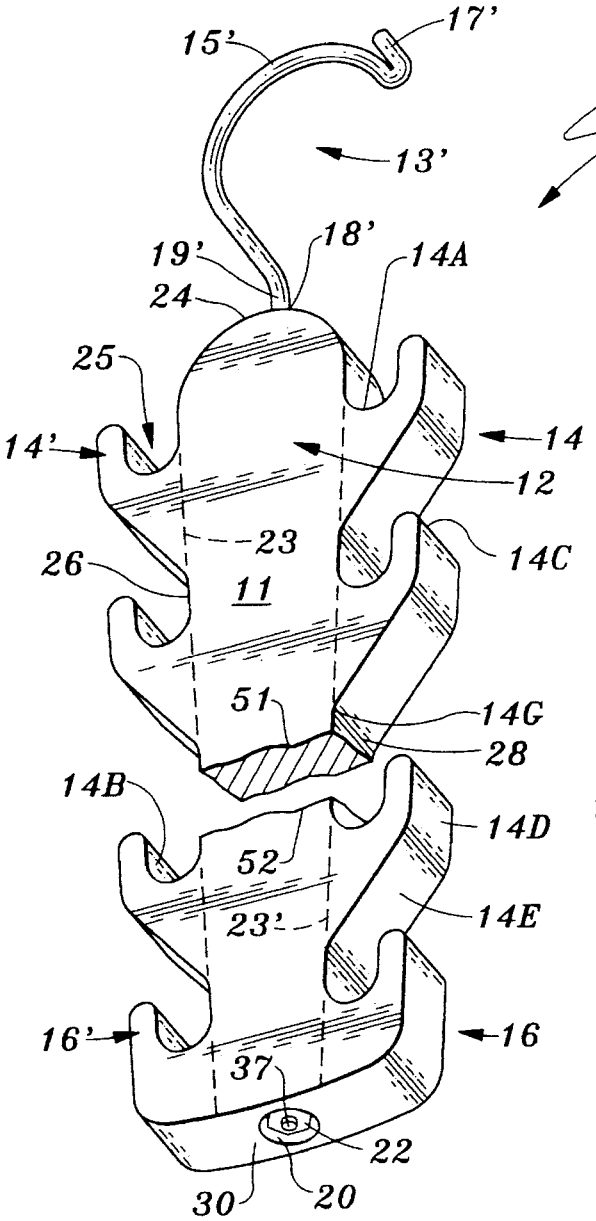
FIG. 9 is a lower right perspective of a variant of both of the first and second embodiments.

In the embodiments of FIGS. 1, 5 and 9 as will be seen, garments on hangers are hung preferably from the bottom up toward the uppermost receiver as the receivers are disposed closer to the main body 11 commencing at the bottom of the body and moving upwardly. The taper permits garments on ascending upstanding segments or in the slots of ascending receivers to overlay one another as they are further and further away from the vertical central axis of the main body.

The hook portion 13 of each of these embodiments includes a first curved section 15, which has a folded over section 17 at the distal end thereof. This folded section may be bent upwardly or downwardly as may be desired. The bend is present for added strength, and to prevent snags on clothing garments and could be omitted if desired.

At the opposite end or proximal end of the curved section is a straight section 19 which is disposed away from the curved section of said hook portion. The straight section has a terminal thread (not visible thereon). This thread is intended to be threadedly engaged into a central bore, 18 on the top wall 24 of the main body. Bore 18 may be about ⅛th inch in diameter and extend down into the body about 2" to 3" from the top wall 24. The figures all show such engagement.

The hook may be formed from any suitable metallic wire as is known in the art. It is also believed that certain plastics having high tensile strength would also be suitable to serve as a hook portion.

Figure 7:
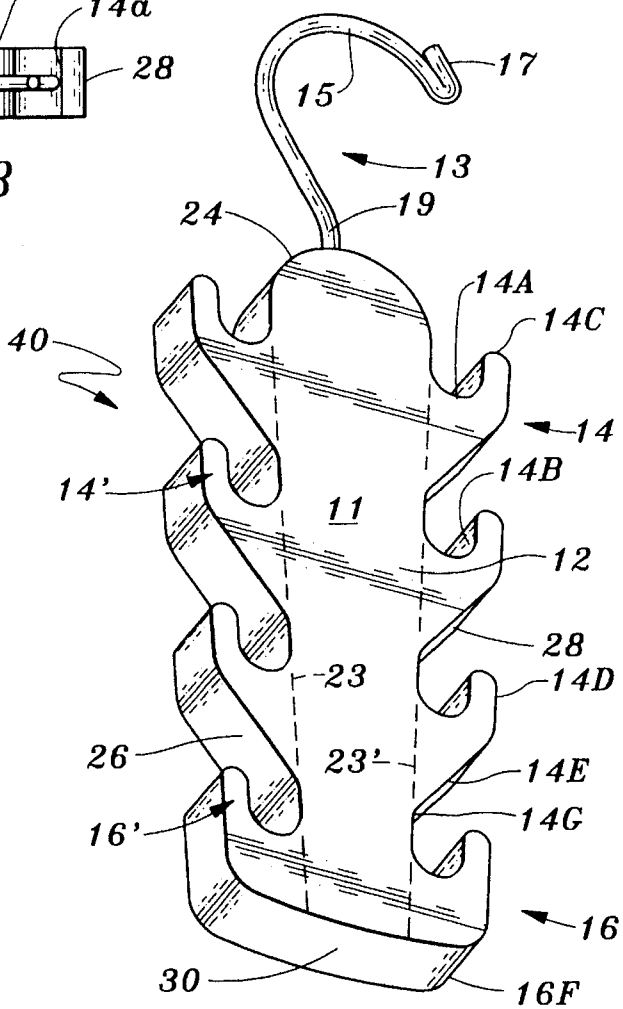
FIG. 7 is a bottom left perspective view of the second embodiment.
Figure 8:
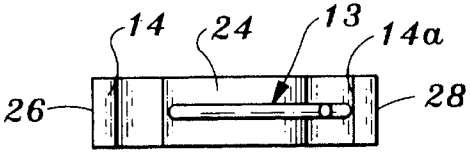
FIG. 8 is a top plan view of the second embodiment.
Figure 6:
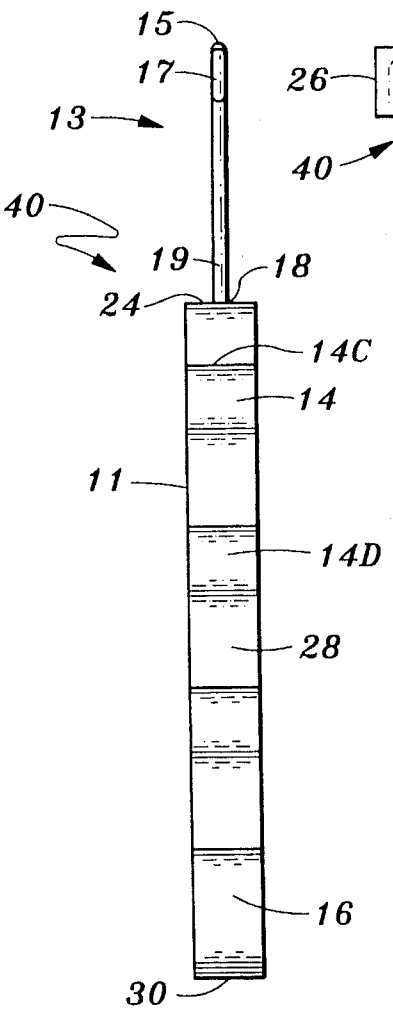
FIG. 6 is a right side elevational view thereof.

FIGS. 2, 3, 4, 6, 7, and 8 have not been separately discussed, since it is believed that further discussion is not needed as they are present only to help illustrate the actual shape of the devices 10 and 40. All elements of these two embodiments have been previously discussed since all are readily seen in FIGS. 1 and 5. FIG. 8 shows central disposition of the hook relative to the body.

The discussion now turns to the embodiment 50 of FIG. 9. The main body 11 is similar to the main body of the first two embodiments as previously discussed. The nonexistent lines 51 and 52 are shown on the drawing to illustrate the fact that any number of receivers may be employed. The actual minimum number would be either of two receivers 14 and none of the 16 variety or two of the element 16 variety and none of the element 14 variety, up to any practical number of receiver elements, such as 10 or 12 which might be utilizable in currently fashionable high-low double bar closets which are used for the hanging of suits and shirts.

In this embodiment, the hook 13' is not threaded into a bore 18 as above. Instead bore 18' is made longitudinally all the way through the body 11 from the top wall 24, to and through the bottom wall, 30. Preferably a recess 20 of a suitable cross section is cut into the bottom wall 30 to permit the receipt of a nut such as hex nut 17. The hook 13' having an elongated straight section 19' is inserted into and through the bore 18' such that its threads, not seen, can threadedly engage nut 17. To facilitate this activity, bore 18' should be slightly greater in diameter than the diameter of the straight portion of hook 18'.

While the use of a recess 20 enhances the aesthetic appearance of the device 50, such is not required as the nut 17 could be placed flush with the bottom wall 30 rather than being inserted slightly into the body as shown in the drawing.

Figure 10:
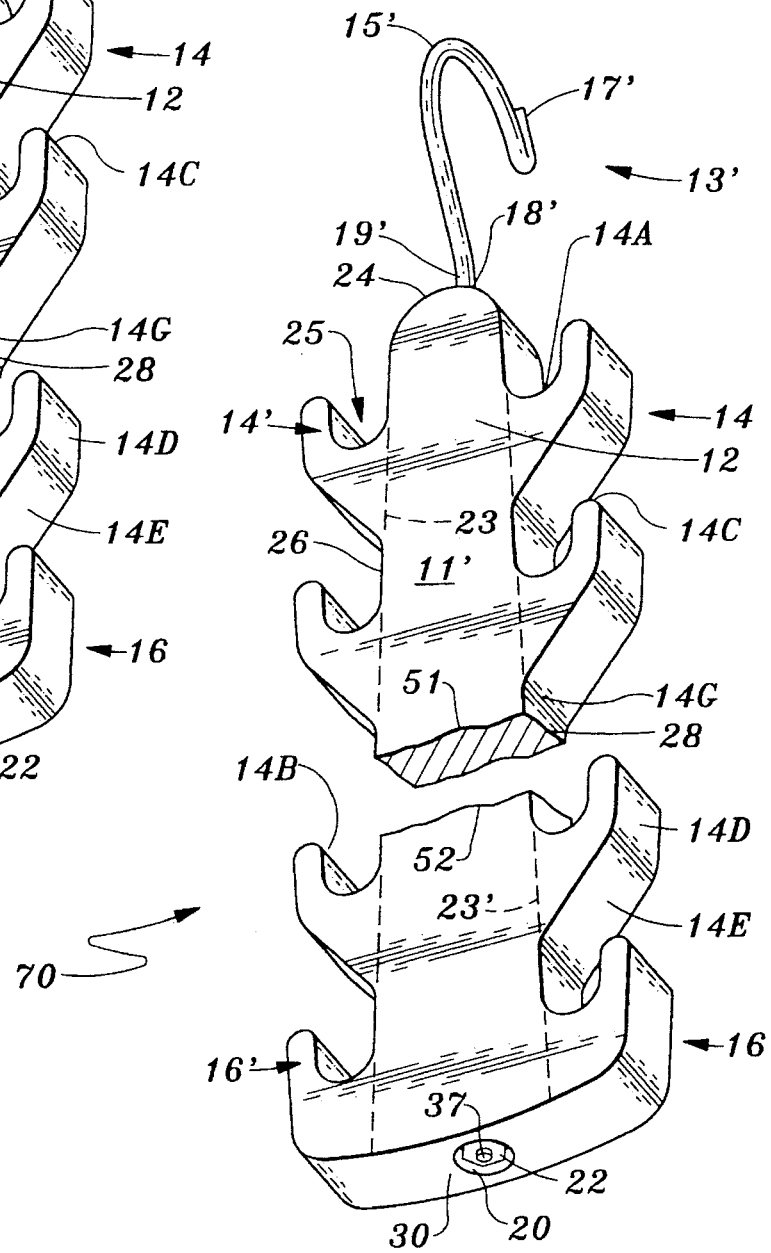
FIG. 10 is an inverted alternative to the embodiments of FIGS. 1, 5 and 9.

The embodiment of FIG. 10 is seen to be a structural alterative to the embodiments of FIGS. 1, 5, and 7. That is, the hook portion can either be inserted at the top or it may extend all the way through as in the FIG. 7 embodiment. This embodiment may also have any number of receiver elements, the limitation being the practical length from the hanger bar to the floor when garments are disposed thereon. The point of this embodiment is to illustrate the fact that the main body may be inverted such that garments are disposed increasingly outward as they are placed in a vertical descending order on the device, as opposed to increasingly inward as they are placed on the device as discussed in the text pertaining to the previous embodiments. Here first garments would be hung at the top of the device.

Figure 11:
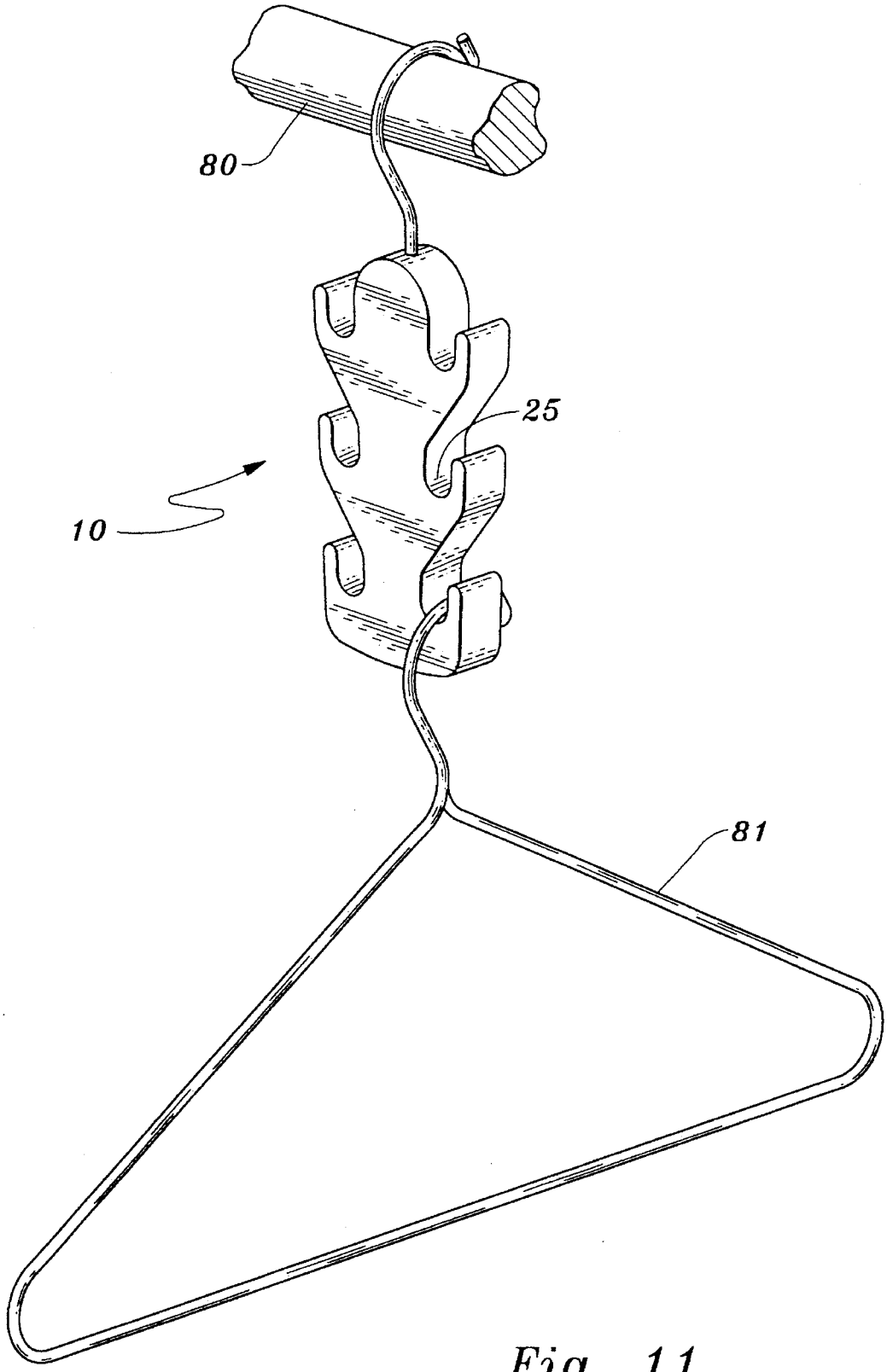
FIG. 11 is a perspective view showing one embodiment of this device disposed on a clothes bar, and an empty hanger set within the slot of one of the hanger receivers of the device.

The reader's attention is also directed to the fact that the hook portion 13 shown in FIGS. 10 & 11 has been oriented for the disposition of garment hangers within each receiver, for maximum space saving. Whereas in FIGS. 1, 5 and 9 for example the hook portion be it 13 or 13' is more appropriately oriented for the disposition of garment hanger loops thereon such as are found in T-shirts and sweaters. A simple twist of the hook a quarter turn to move the thread will orient the main body for the type of use desired. One direction for garments on hangers to point front to back in the closet, and 90 degrees opposite for hanging loop garments to be positioned, some toward the rear wall and the balance of the garments facing the user in the open closet.

It is preferred that the receivers be formed integral with the main body member by cutting out the combination of main body and the plurality of receivers from a single piece of incense cedar and the like. If chips are used to form the device, then a single mold that integrates the receivers and the main body should be employed. Alternatively, but acceptable is to form separate receivers as by cutting from a suitable wood and adhesing them or otherwise securing them in the desired spatial relationship upon a main body member. Separate molded receivers can be formed and then attached to a main body member. It is also within the scope to combine a wood main body member with molded receivers and vice-versa.

FIG. 11 illustrates the disposition of a device 10 upon a typical clothes bar 80 as found in a closet. The device 10 has a conventional clothes hanger 81,—though lacking a garment thereon,—disposed within a slot 25 of a device 10.

It is seen that there has been provided a unique device that serves triple duty. First it serves as a multigarment hanger. This is accomplished by placing the hook portion of any conventional wood, wire or plastic hangers into one of the slots of one or more of the receivers. Second, jackets, blouses and shirts which have hanging loops thereon can be stored on the devices of this invention by placing the loop onto the upstanding segment of a receiver 14, 16. Thirdly, device 10, due to the presence of the incense cedar or similar odoriferous material serves to inhibit the growth and life maintenance of moths, silverfish and certain other insects which eat wool, cotton and certain other fabrics.

While the hook 13 is shown with an upturned end, it is within the scope of the invention to provide a hook end 17 that is either looped, down turned or straight. The hook of either of the main embodiments or the variant may be formed from wire of steel, aluminum, or other metal or such plastics as polycarbonate.

While a solid member for the body is preferred in order to maximize the amount of cedar or other odoriferous wood available, as noted earlier a resin binder with which chips of cedar and the like are glued on and formed into the desired configuration in a mold should provide a similar insect inhibiting effect. The binding of wood chips with resin is known in the art, and need not be discussed here at length. Since the general configuration would be the same, no matter which mode of construction were to be utilized, a unit featuring this construction mode is not separately illustrated. It is also within the scope of this invention to mold cedar or similar wood shavings and/or dust with a resin to form the body and the receivers.

In order to increase the surface area of the main body, to increase its insect inhibiting effect, incisions may be made in the form of shallow cuts such as V-grooves. Such grooves should not be overly deep, since to do so could effect the structural strength of the device.

The main body, as shown, is seen to be tapered downwardly and upwardly. An inward taper of about ⅛-inch on each side from vertical receiver to vertical receiver provides sufficient offset to permit easy entry of a conventional hanger onto the next lower receiver's slot, and adequate clearance for the disposition of adjacent garments.

It is seen that in addition to providing insect infestation protection, the devices of this invention, also provide closet organization by permitting one to hang for example a plurality of suits at the same location, all for easy access.

The devices also provide space saving in the closet in that when the clothes bar and main body are in a disposition 90° apart, less than six (6) inches of closet space will be utilized to hold a large number of garments.

When the clothes bar and main body are in parallel alignment, only the width of a hanger is employed for the disposition of a plurality of garments limited only the occupancy capacity of the device of the invention. The device also permits the user to compactly group similar garments together for organization of the closet.

Since certain changes may be made in the above described apparatus without departing from the scope of the invention herein involved, it is intended that all matter contained in the above description and shown in the accompanying drawings shall be interpreted as illustrative and not in a limiting sense.

I claim:

1. A multigarment, closet space saving, insect infestation inhibiting hanger device for use on a clothes bar which comprises:

(a) a hook portion for disposition on a clothes bar in engagement with (b) a main body member having a top wall and a bottom wall, two spaced diverging side walls, a front wall and a rear wall, and having at least one pair of opposed mirror image receivers, each of which comprises a substantially vertical slot, said slot having a first angled portion and a second vertical portion, said second vertical portion having an arcuate convex base portion bounded by vertical edges on both sides and which receivers depend outwardly from opposite walls of said body member, each of said receivers for receiving both a conventional clothing hanger therein and a garment hanging loop thereon, wherein the main body member is tapered such that one of the top wall and the bottom wall are of different dimensions, and the main body member consists essentially of a clothes eating insect infestation inhibiting wood.

2. The hanger device of claim 1 wherein the device has three receivers vertically disposed along each side wall.

3. The hanger device of claim 1 wherein the device has four receivers vertically disposed along each side wall.

4. The device of claim 1 wherein each receiver comprises the combination of a slot and a generally upstanding solid segment, and a supporting section therebeneath.

5. The device of claim 4 wherein the upstanding segment comprises a finger-like structure having an inner edge, which extends upwardly a finite distance to a point of termination at the first end of an upper edge which upper edge in turn terminates at a generally vertical edge, preferably parallel to and spaced from said inner edge.

6. The device of claim 5 wherein the upper edge of said upstanding segment is an arcuate convex edge.

7. The device of claim 5 wherein the upstanding segment has a diameter less than the convex portion of said slot.

8. The device of claim 7 wherein the inner and outer edges of said upstanding member are parallel, and the distance therebetween does not exceed about ¼ inch.

9. The device of claim 1 wherein the hook portion has a distal end and is threadedly engaged to said main body member.

10. The device of claim 1 wherein the hook portion has a distal end and includes a terminal thread and passes vertically through said main body member and said hook portion is retained in said body member by a nut disposed on the threaded terminal of said hook.

11. The device of claim 9 wherein the hook has its distal end folded for structural strength.

12. The device of claim 10 wherein the hook has its distal end folded for structural strength.

13. The hanger device of claim 1 wherein the device has at least two receivers vertically disposed along each side wall.

14. The hanger device of claim 1 wherein the insect infestation inhibiting wood is incense cedar.

15. A multigarment, closet space saving insect infestation inhibiting hanger device for use on a clothes bar which comprises:

(a) a hook portion for disposition on a clothes bar in engagement with (b) a main body member having a top wall and a bottom wall, two spaced diverging side walls, a front wall and a rear wall, and having at least one pair of opposed mirror image receivers on opposite walls of said body member, and each of said receivers for receiving both a conventional clothing hanger therein and a garment hanging loop thereon, wherein the main body member consists essentially of a clothes eating insect infestation inhibiting wood and wherein the hook portion has a distal end and is threadedly engaged to said main body member and the hook's distal end is folded for structural strength, and wherein each receiver includes a substantially vertical slot, said slot having a first angled portion and a second vertical portion, said second vertical portion having an arcuate convex base portion bounded by vertical edges on both sides.

16. A multigarment, closet space saving, insect infestation inhibiting hanger device for use on a clothes bar which comprises:

(a) a hook portion for disposition on a clothes bar in engagement with (b) a main body member having a top wall and a bottom wall, two spaced divergent side walls, a front wall and a rear wall, and having at least one pair of opposed mirror image receivers on opposite walls of said body member, each of said receivers for receiving receive both a conventional clothing hanger therein and a garment hanging loop thereon, wherein the main body member consists essentially of a clothes eating insect infestation inhibiting wood and wherein the hook portion has a terminal threaded section, and which hook passes through said main body member and is retained by a nut threadedly engaged therewith, and wherein each receiver comprises includes a substantially vertical slot, said slot having a first angled portion and a second vertical portion, said second vertical portion having an arcuate convex base portion bounded by vertical edges on both sides generally vertical.

17. The device of claim 15 wherein there are between three and four receivers on each side of the main body member and the main body is incense cedar.

18. The device of claim 16 wherein there are between three and four receivers on each side of the main body member and the main body is formed of molded incense cedar and resin.

* * * * *